US009038342B2

(12) United States Patent
Hassan

(10) Patent No.: US 9,038,342 B2
(45) Date of Patent: May 26, 2015

(54) UNITARY SAFETY SURFACE TILES AND ASSOCIATED STRUCTURES

(71) Applicant: Morris Hassan, Lakewood, NJ (US)

(72) Inventor: Morris Hassan, Lakewood, NJ (US)

(73) Assignee: Playsafer Surfacing LLC a division Rubberecycle, Lakewood, NJ (US)

( * ) Notice: Subject to any disclaimer, the term of this patent is extended or adjusted under 35 U.S.C. 154(b) by 0 days.

(21) Appl. No.: 14/135,482

(22) Filed: Dec. 19, 2013

(65) Prior Publication Data

US 2014/0182227 A1 Jul. 3, 2014

Related U.S. Application Data

(60) Provisional application No. 61/747,887, filed on Dec. 31, 2012.

(51) Int. Cl.

| | |
|---|---|
| ***E01C 15/00*** | (2006.01) |
| ***E01C 13/00*** | (2006.01) |
| ***E01C 13/06*** | (2006.01) |
| ***E01C 3/00*** | (2006.01) |
| ***E01C 13/04*** | (2006.01) |

(52) U.S. Cl.

CPC ..... *E01C 13/00* (2013.01); *E01C 13/06* (2013.01); *E01C 15/00* (2013.01); *E01C 3/006* (2013.01); *E01C 13/045* (2013.01)

(58) Field of Classification Search

CPC ..... E01F 15/225; E01C 13/00; E01C 13/06; E01C 15/00

USPC ..... 52/403.1, 177, 180, 181, 384, 386–387, 52/512, 783.1, 783.11, 783.17, 783.18, 52/789.1, 790.1, 793.1, 793.11, 144–145; 472/92–94; 428/95; 404/32, 34–35, 37, 404/40; 405/34–36, 43, 49–50

See application file for complete search history.

(56) References Cited

U.S. PATENT DOCUMENTS

| | | | | |
|---|---|---|---|---|
| 1,344,767 | A * | 6/1920 | Madison | 52/454 |
| 2,792,164 | A * | 5/1957 | Cauffiel | 182/194 |

(Continued)

FOREIGN PATENT DOCUMENTS

| | | |
|---|---|---|
| DE | 2946242 | 5/1981 |
| WO | WO 03000994 | 1/2003 |

OTHER PUBLICATIONS

International Search Report for International Application No. PCT/US13/78203, May 7, 2014.

(Continued)

*Primary Examiner* — Beth Stephan
(74) *Attorney, Agent, or Firm* — Weiss & Arons LLP

(57) ABSTRACT

A unitary safety surface tile is provided. The tile may interlock with at least one other tile. The tiles may be configured for disposing on a base of loose fill and for receiving a covering of loose fill. The tiles may include a plurality of hollow inverted pyramidal shaped pockets. Each of the pockets may connect to at least two other pockets along a top edge of each pocket. Each of the pockets may engage the base of loose fill and/or receive the covering of loose fill. Each of the pockets may include one or more apertures for allowing passage of fluid through each of the pockets. Each tile may further include a plurality of edges. The edges may border the plurality of pockets. Each of at least two of said plurality of edges may be adapted for engaging at least one edge of at least one other tile.

6 Claims, 3 Drawing Sheets

(56) References Cited

U.S. PATENT DOCUMENTS

| | | | | | |
|---|---|---|---|---|---|
| 2,840,179 | A | * | 6/1958 | Junger | 181/286 |
| 3,025,935 | A | * | 3/1962 | Ensrud et al. | 428/98 |
| 3,507,634 | A | * | 4/1970 | O'Driscoll | 428/573 |
| 3,814,208 | A | * | 6/1974 | Morresi et al. | 181/293 |
| 4,292,375 | A | * | 9/1981 | Ko | 428/593 |
| 4,965,138 | A | * | 10/1990 | Gonzalez | 428/593 |
| 5,026,207 | A | | 6/1991 | Heath | |
| 5,052,161 | A | * | 10/1991 | Whitacre | 52/385 |
| 5,105,595 | A | * | 4/1992 | Tokei et al. | 52/381 |
| 5,198,626 | A | * | 3/1993 | Pelzer | 181/291 |
| 5,234,738 | A | | 8/1993 | Wolf | |
| 5,292,130 | A | | 3/1994 | Hooper | |
| 5,383,314 | A | | 1/1995 | Rothberg | |
| 5,509,244 | A | * | 4/1996 | Bentzon | 52/387 |
| 5,527,128 | A | * | 6/1996 | Rope et al. | 404/35 |
| 5,665,943 | A | * | 9/1997 | D'Antonio | 181/295 |
| 5,714,263 | A | | 2/1998 | Jakubisin et al. | |
| 5,894,045 | A | * | 4/1999 | Desrondiers | 428/178 |
| 5,930,970 | A | * | 8/1999 | De Le fevre | 52/630 |
| 6,065,266 | A | * | 5/2000 | Behr et al. | 52/630 |
| 6,131,005 | A | * | 10/2000 | Ozawa | 399/107 |
| 6,221,445 | B1 | | 4/2001 | Jones | |
| 6,720,069 | B1 | * | 4/2004 | Murakami et al. | 428/319.3 |
| 6,777,062 | B2 | | 8/2004 | Skaja | |
| 6,786,013 | B2 | * | 9/2004 | Coulton | 52/198 |
| 7,033,666 | B2 | | 4/2006 | Skaja | |
| 7,182,994 | B1 | * | 2/2007 | Scott | 428/131 |
| 7,308,965 | B2 | * | 12/2007 | Sapoval et al. | 181/210 |
| 7,950,191 | B2 | * | 5/2011 | Brouwers | 52/180 |
| 8,122,656 | B1 | * | 2/2012 | Poulsen | 52/232 |
| 8,353,640 | B2 | | 1/2013 | Sawyer | |
| 2005/0241877 | A1 | * | 11/2005 | Czerny et al. | 181/293 |
| 2007/0087154 | A1 | | 4/2007 | Bird et al. | |
| 2007/0131666 | A1 | * | 6/2007 | Gregg et al. | 219/213 |
| 2009/0038883 | A1 | * | 2/2009 | Kim | 181/291 |
| 2010/0293877 | A1 | | 11/2010 | Harris et al. | |
| 2011/0005165 | A1 | * | 1/2011 | Stadthagen-Gonzalez | 52/783.1 |

OTHER PUBLICATIONS

"ADA Beach Access Mats," General Recreation, Inc., 2013.
"Playground Injuries: Fact Sheet," Centers for Disease Control and Prevention (CDC), Mar. 29, 2012, Atlanta, Georgia.
"Public Playground Safety Handbook," U.S. Consumer Product Safety Commission, Nov. 2010, Bethesda, Maryland.
"Playground Safety," National Safety Council, Feb. 2011.
"2010 ADA Standards for Accessible Design," Department of Justice, Dec. 7, 2012.
Non-Final Office Action for U.S. Appl. No. 14/135,492, Dec. 12, 2014.

* cited by examiner

UNITARY SAFETY SURFACE TILES AND ASSOCIATED STRUCTURES

This application is a non-provisional application of U.S. Provisional Application No. 61/747,887, filed Dec. 31, 2012, which is hereby incorporated by reference herein in its entirety.

FIELD OF TECHNOLOGY

Aspects of the disclosure relate to surface tiles. More particularly, the disclosure relates to surface tiles, and associated structures, for use in playgrounds, beaches and/or in other suitable areas.

BACKGROUND

Every year, over 200,000 playground injuries result in emergency room visits and over 79% of those injuries are from falls. To protect children from fall injuries, playgrounds are required to install a safety surface.

The safest playground surface is a loose fill material such as shredded rubber, sand or wood fiber. Not only is such loose fill material the safest surfacing option, but it is also the most cost effective. While such loose fill material provides a relatively safe surface, such loose fill typically provides relatively poor wheelchair accessibility.

The American Disabilities Act (ADA) requires that all public playgrounds and beaches be accessible to disabled people. ADA standards require a unitary safety surface such as rubber tiles or poured-in-place rubber. These surfaces are relatively hard and do not provide much cushion to protect children from falls. These surfaces rate high on accessibility but low on safety.

New ADA standards may one day eliminate the use of loose fill materials on playgrounds because of the low accessibility. However, such new ADA standards may make playgrounds unsafe and cause more injuries. In addition, elimination of the use of loose fill materials may force playground owners to install costly unitary surfaces. In certain instances, the cost of a unitary surface may well exceed the cost of associated play equipment.

SUMMARY

Solutions to this challenge—i.e., of providing a relatively safe, yet wheelchair accessible play area—preferably include mat/tile embodiments (hereinafter referred to as a "mat/tile".) Such mat/tiles may include inverted hollow pyramids, inverted hollow frusto-conical shapes, depressions or other suitable pockets (collectively hereinafter, "pockets".) Such suitable shapes may include any shape that is sufficient to engage a base of loose fill material (hereinafter, "loose fill"), while maintaining pockets for deposit of loose fill from above.

The mat/tile may be placed on top of a base of any loose fill material and then topped with ½", ¾", 1" or a couple inches, or some other suitable amount, of the same, or other, loose fill. The shaped underside of the pockets may engage the base of loose fill. It should be noted that for the purposes of this application, loose fill may include crumb rubber, shredded rubber, wood fill, sand or any other suitable loose fill or any combination of suitable loose fill components.

Once the pockets of the mat/tile are packed with loose fill product, the mat/tile may exhibit properties akin to a unitary surface, at least with respect to its ease of access for a wheelchair rider.

At the same time that the mat/tile may provide a preferably wheelchair-accessible surface, the loose fill under, nestled in and/or laying on top of the mat/tile may maintain a high safety factor for the playground. In real-life tests, the mat/tile rates high on ASTM 1951 tests and in tests using the currently-proposed rotational penetrometer manufactured by Beneficial Designs, Inc of Minden, Nev.

The mat/tile can be used with preferably any suitable loose fill product such as crumb rubber, shredded rubber, wood fiber, stone gravel and sand. The mat/tile also preferably helps to keep the loose fill material in place. The cost of a loose fill product in combination with the mat/tile is still considerably less than that of a conventional unitary surface, providing both safety and accessibility at a reduced cost.

In certain embodiments, the mat/tile can be installed in the whole playground or other suitable area. The mat/tile can be installed along the access routes of a playground or other suitable area. Access routes may typically account for half of the play area or other suitable area.

Being that this product can be used with sand, it can also be used to make a public beach or other suitable outdoor area preferably ADA-accessible.

The pockets of the mat/tile can be constructed having a depth from between about 1" and about 6" or any other suitable depth. Some embodiments of the pockets may preferably have a suitable aperture at the downward-facing tip of the pocket. The aperture may preferably allow water and/or other liquid to drain into the loose fill underlying the mat/tile. While it is preferable to locate the aperture at the downward-facing tip of the pocket, aperture(s) may also be placed along the sloping sides of the pockets.

In one embodiment in which the mat/tile may preferably be square, the size of the mat/tile may range from 12"×12" to 48"×48", or may be of any other suitable square size. The mat/tile can be made smaller than 12"×12" and/or larger than 48"×48". In one preferable embodiment, a 30" by 30" mat/tile may also be used. In such an embodiment, there may be 8 pockets by 8 pockets for a total of 64 pockets. In such an embodiment, each pocket may be slightly less than 3" by 3".

The mat/tile can be rectangular. The mat/tile can be triangular. The mat/tile can be any suitable shape.

Similar size and/or shape mat/tiles may be attached to one another. Different size and/or shape mat/tiles may be attached to one another. Mat/tiles may be attached to one another along their periphery, preferably along the edges.

The mat/tile can be made from plastic, recycled rubber or both. The mat/tile can be made from any suitable material. Using recycled rubber to produce the mat/tiles may be preferable because of the easy access to supply as well as reduced production costs.

The mat/tile can be available in a variety of colors. One color option may preferably be black because black may be the most available color for recycled rubber. Tan can be used to match the sand at the beach and vibrant colors may be used to match play equipment. Such color can be formed by adding pigment to the rubber.

In one embodiment, the mat/tile may be installed using the following method of installation. Loose fill may be spread to a depth of 1", 2", 3", 4", 5", 6", 7", 8", 9" or any suitable depth. The loose fill may be spread on an ungraded base.

Alternatively, loose fill surface material may be spread on any playground base or on any other suitable surface.

The mat/tile may be laid over the material. Individual mat/tiles may be interlocking.

Any suitable fastener may be used to lock one tile to the next. The mat/tiles may be fastened together by placing any type of fasteners in pre-drilled apertures that may be found on the side of preferably every mat/tile.

Alternatively, a male or female fastener may be integrated into one, two or more edges of the mat/tile. The male or female fastener on a first tile may be adapted for engaging a complementary fastener on a second tile.

In addition, another layer of loose fill may be spread over the mat/tiles. The additional layer of loose fill may be sufficient to fill the pockets of the mat/tiles. The additional layer of loose fill may rise between about 0" and 3" on top of the mat/tile, or may be of other depths compatible with ADA accessibility standards.

FIG. 1 shows a top plan view of an embodiment of a mat/tile 100. Mat/tile 100 includes pockets 102.

Pockets 102 may preferably include one or more apertures 104. Apertures 104 may preferably be located at the bottom of the pockets. Apertures 104 may preferably be centered within the pocket. In certain embodiments, one or more apertures may be located along the sloping sides of the pockets.

Mat/tile 100 may also include edge 106. Edge 106 may preferably include projections 108. Mat/tile 100 may also include edge 110. Edge 110 may include holes 112. Such holes may be configured to mate with projections on a second tile. Projections and holes are described in more detail in the portion of the specification corresponding to FIGS. 4 and 5. Edge 106 may be any suitable thickness, but preferable embodiments of edge 106 may be between ⅛" to 1" thick.

FIG. 2 shows a perspective view of mat/tile 200. Mat/tile 200 includes pockets 202. The blunted tips of pockets 202 indicate the presence of apertures 204.

FIG. 2 also shows edges 206. Edges 206 may include projections 208 and/or holes 210. While embodiments in this application are shown with integrated edges, where one edge includes projection(s) for mating with aperture(s) on a second edge, it should be noted that suitable coupling devices may be separate from mat/tiles, and may be used to couple individual tiles to one another. In yet other alternative embodiments, the tiles may be snapped together, zipped together, engaged with one another using locking mechanisms such as interlocking strips, or in any other suitable fashion—whether integrated into the tiles, or separate therefrom.

In one embodiment, pockets 202 may be 3" by 3" at the top. A preferably range of pocket side length may be between about 1.5" and about 4.5" for both width and length. It should be noted that pockets may be formed in shapes other than squares—e.g., circles, ovals, triangles, rectangles, trapezoids, hexagons, octagons, or any other suitable shape.

FIG. 3 shows a side view of an embodiment of a mat/tile 300. Pockets of mat/tile 300 may preferably include depth 302. Depth 302 may preferably be about 2.5", but may also be between about 1" and about 6" or any other suitable depth.

FIG. 3 shows an angle θ to represent the angle of the side of the pocket with respect to the horizontal plane of the tile. Angle θ may be any suitable angle that promotes engagement of mat/tile 300 with loose fill located under mat/tile 300.

While the pockets are shown in FIGS. 1 and 2 as pyramid-shaped, nevertheless, pockets may be formed in any suitable shape. For example, pockets may be formed in a frusto-conical shape. Pockets may be formed in a stepped pyramid shape. Pockets may be formed in any suitable shape that allows the pockets to engage loose fill beneath the mat/tile, hold loose fill above the mat/tile and preferably allow liquid to pass through the mat.

Mat/tile 300 may also include thickness 306. Thickness 306 may represent the thickness of the edges. Line 308 may represent the topmost level of mat/tile 300. Total height of mat/tile 300 may include the sum of 302 and 306.

In certain embodiments, edges 406 and 506 may be formed with projections that enlarge (not shown) toward the distal tip of the projection. As such, the projections may lock into the apertures such that a special tool may be required to lock the edges together, and a special tool may be required to separate the edges.

Figure 1:
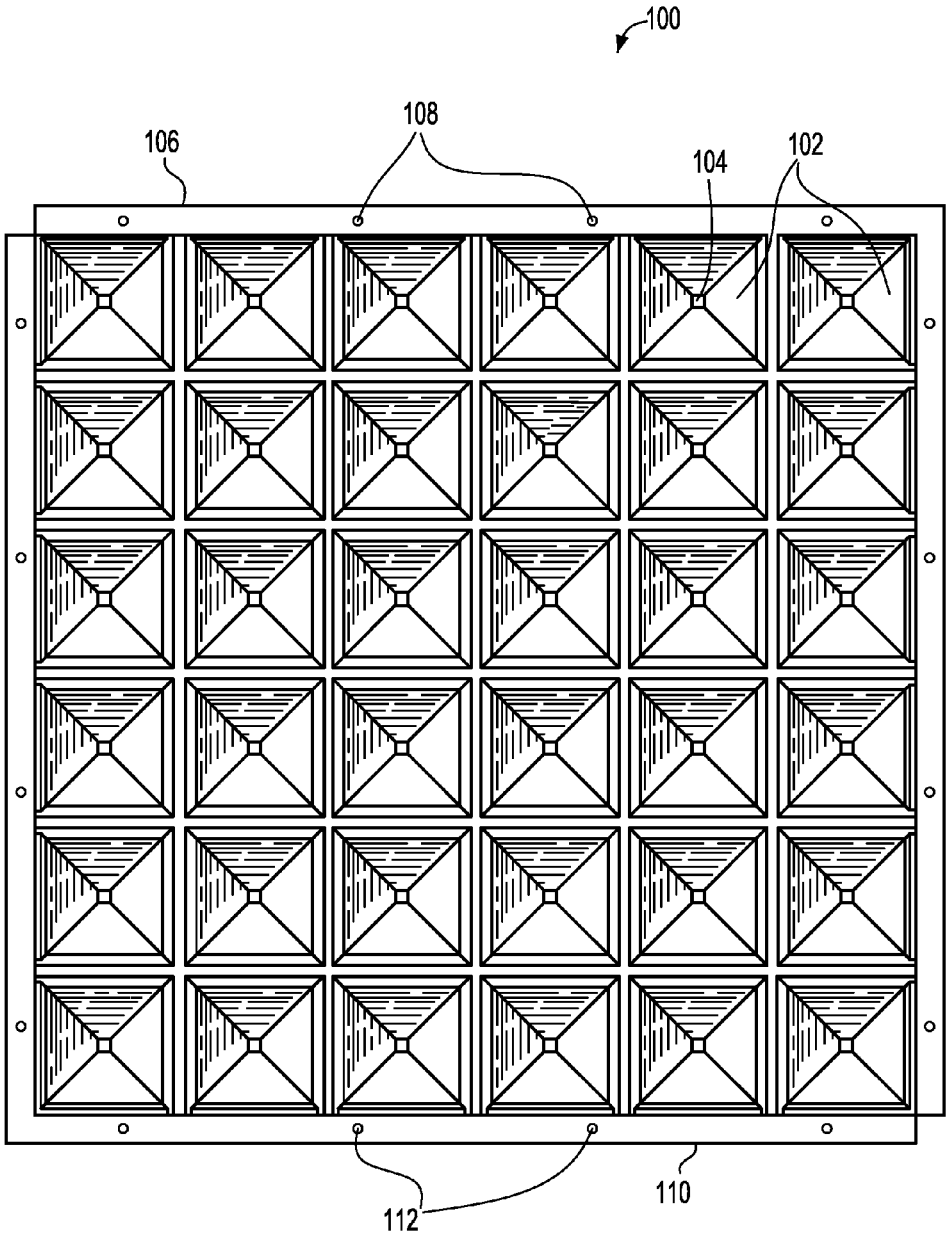
Figure 2:
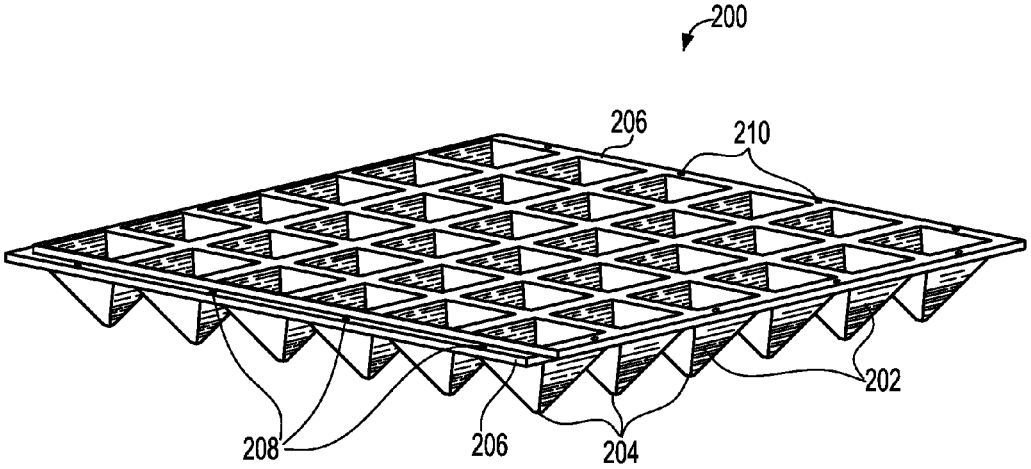
Figure 3:
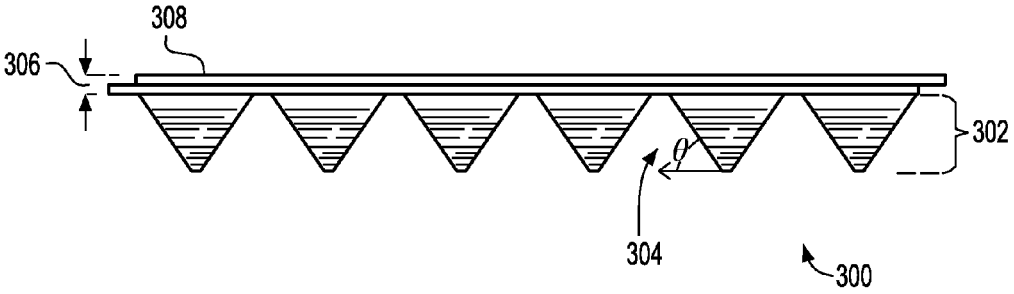
Figure 4:
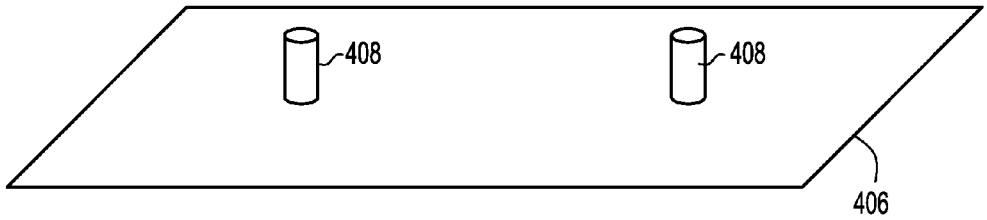
FIG. 4 shows an enlarged portion of an edge 406 from FIGS. 1-3. Edge 406 preferably includes projections 408.
Figure 5:
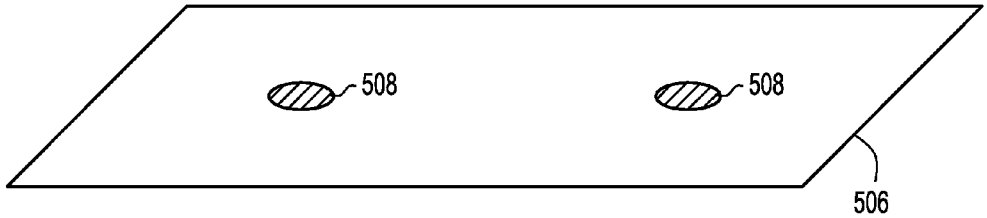
FIG. 5 shows another enlarged portion of an edge 506 from FIGS. 1-3. Edge 506 includes apertures 508.
Figure 6:
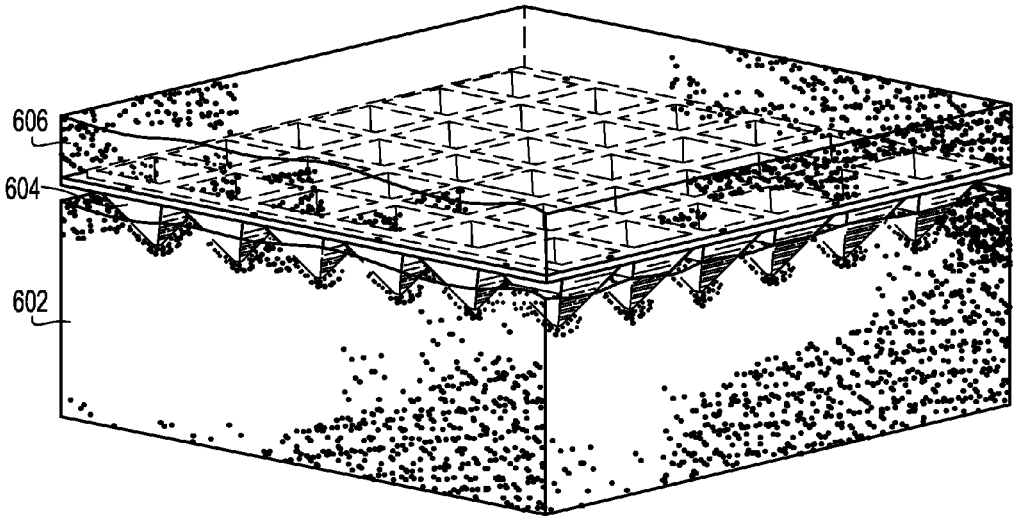

FIG. 6 shows an embodiment of a base of loose fill 602, mat/tile 604 and loose fill topping 606.

Thus, apparatus and methods for unitary safety surface tiles and associated structures have been provided. Persons skilled in the art will appreciate that the present invention can be practiced by other than the described embodiments, which are presented for purposes of illustration rather than of limitation. The present invention is limited only by the claims that follow.

What is claimed is:

1. A rubber unitary safety surface tile and environment, said tile for interlocking with at least one other unitary safety surface tile, said tile and environment comprising:

a base of loose fill;

a cover of loose fill;

a top tile surface and a bottom tile surface, the top surface covered by the cover of loose fill, the bottom surface disposed on the base of the loose fill;

a plurality of hollow inverted pyramidal shaped rubber pockets extending from the top surface of the tile through the bottom surface, each of said pockets comprising a top edge and a bottom edge, the top surface of the tile connected to and between at least two of said pockets along the top edge of each of said pockets, each of said pockets for engaging the base of loose fill and for receiving said covering of said loose fill therein, each of said pockets further comprising at least one aperture in the bottom edge of the pocket for allowing the passage of fluid through each of the pockets; and a plurality of side edges proximate the top surface, wherein the plurality of side edges form a border around the plurality of hollow inverted pyramidal shaped pockets adjacent the top edges of the pockets, each of at least two of said plurality of side edges for engaging at least one other unitary safety surface tile.

2. A rubber unitary safety surface tile and environment, said tile for interlocking with at least one other unitary safety surface tile, said tile and environment comprising:

a base of loose fill;

a cover of loose fill;

a top tile surface and a bottom tile surface, the top surface covered by the cover of loose fill, the bottom surface disposed on the base of the loose fill;

a plurality of hollow inverted frusto-conically shaped rubber pockets extending from the top surface of the tile through the bottom surface, each of said pockets comprising a top edge and a bottom edge, the top surface of the tile connected to and between at least two of said pockets along the top edge of each of said pockets, each of said pockets for engaging the base of loose fill and for receiving said covering of said loose fill therein, each of said pockets further comprising at least one aperture in the bottom edge of the pocket for allowing the passage of fluid through each of the pockets; and a plurality of side edges proximate the top surface, wherein the plurality of side edges form a border around the plurality of hollow inverted frusto-conically shaped pockets adjacent the top edges of the pockets, each of at least two of said plurality of side edges for engaging at least one other unitary safety surface tile.

3. A rubber unitary safety surface tile and environment, said tile for interlocking with at least one other unitary safety surface tile, said tile and environment comprising:

a base of loose fill;

a cover of loose fill;

a top tile surface and a bottom tile surface, the top surface covered by the cover of loose fill, the bottom surface disposed on the base of the loose fill;

a plurality of hollow rubber pockets extending from the top surface of the tile through the bottom surface, each of said pockets comprising a top edge and a bottom edge, the top surface of the tile connected to and between at least two of said pockets along the top edge of each of said pockets, each of said pockets for engaging the base of loose fill and for receiving said covering of said loose fill therein, each of said pockets further comprising at least one aperture in the bottom edge of the pocket for allowing the passage of fluid through each of the pockets; and a plurality of side edges proximate the top surface, wherein the plurality of side edges form a border around the plurality of hollow shaped pockets adjacent the top edges of the pockets, each of at least two of said plurality of side edges for engaging at least one other unitary safety surface tile.

4. The rubber unitary safety surface tile and environment of claim 1 wherein the loose fill comprises a loose fill of rubber.

5. The rubber unitary safety surface tile and environment of claim 2 wherein the loose fill comprises a loose fill of rubber.

6. The rubber unitary safety surface tile and environment of claim 3 wherein the loose fill comprises a loose fill of rubber.

* * * * *